US005860183A

United States Patent [19]

Kam

[11] Patent Number: 5,860,183

[45] Date of Patent: Jan. 19, 1999

[54] SAFETY TOOTH BRUSH WITH WEAR INDICATOR

[76] Inventor: Bing Kam, 6902 Midhurst, Memphis, Tenn. 38119

[21] Appl. No.: 56,958

[22] Filed: Apr. 8, 1998

Related U.S. Application Data

[63] Continuation-in-part of Ser. No. 789,879, Jan. 28, 1997, abandoned.

[51] Int. Cl.[6] ..... A46B 9/04

[52] U.S. Cl. ..... 15/167.1; 15/246

[58] Field of Search ..... 15/110, 167.1, 15/246

[56] References Cited

U.S. PATENT DOCUMENTS

| | | | |
|---|---|---|---|
| 1,532,522 | 4/1925 | Weaver, Jr. | 15/110 |
| 4,628,564 | 12/1986 | Youssef | 15/110 |
| 4,802,255 | 2/1989 | Brever | 15/167.1 |
| 5,052,071 | 10/1991 | Halm | 15/167.1 |
| 5,325,560 | 7/1994 | Pavone | 15/246 |
| 5,373,602 | 12/1994 | Bang | 15/110 |

FOREIGN PATENT DOCUMENTS

| | | | |
|---|---|---|---|
| 2402785 | 7/1975 | Germany | 15/110 |
| 3114307 | 3/1983 | Germany | 15/110 |
| 3628722 | 2/1988 | Germany | 15/167.1 |
| 4122524 | 2/1992 | Germany | 15/167.1 |
| 1725817 | 4/1992 | U.S.S.R. | 15/167.1 |

*Primary Examiner*—Randall E. Chin

[57] ABSTRACT

The present invention is a safety toothbrush with wear indicator. The safety toothbrush provides a safety feature to the conventional toothbrush by attaching a soft bumper to the end of the toothbrush head. The toothbrush head holds the tufts for brushing and is opposite the handle end. The soft bumper is preferably made of an impact absorbing material such as rubber, either natural or synthetic or in the form of the an air cushion, and is attached to the end of the toothbrush head by means of adhesive or embedment or both. The soft bumper is of sufficient thickness to render its effectiveness. An additional useful feature of the safety toothbrush is that the soft bumper is attached in such a manner that the soft bumper or a portion of the soft bumper will become disengaged with the toothbrush head after the toothbrush has experienced a certain amount of wear. The disengagement of the soft bumper with the head not only indicates that the toothbrush should be replaced but presents an unacceptable operating condition causing positive replacement of the toothbrush.

8 Claims, 8 Drawing Sheets

SAFETY TOOTH BRUSH WITH WEAR INDICATOR

CROSS-REFERENCES TO RELATED APPLICATIONS

This is a continuation-in-part of application Ser. No. 08/789,879, entitled "Safety Toothbrush with Wear Indicator," filed Jan. 28, 1997, now abandoned. Such specifically enumerated prior application is hereby incorporated herein by reference.

STATEMENT REGARDING FEDERALLY SPONSORED RESEARCH OR DEVELOPMENT

Not applicable.

BACKGROUND OF THE INVENTION

1. Field of the Invention

This invention relates to toothbrushes and, in particular to toothbrushes that are operated by the movement of a user's hand.

2. Information Disclosure Statement

The most effective way to maintain oral hygiene is by brushing the teeth. The toothbrush is widely accepted as the preferred device used to daily clean one's teeth. A quick glance at the large number of different types of toothbrushes available on the market today indicates that there are several divergent opinions as to what size, shape, material, and construction of toothbrush will maximize cleaning effectiveness. An example of one such patented toothbrush design is disclosed in U.S. Pat. 5,052,071 to Halm.

Regardless of the specific toothbrush design, toothbrushes operated by the user's hand include a generally rigid body made of plastic. One end of the body is called the head which holds the tufts or bristles for brushing and the other end serves as the handle. The user holds the handle and inserts the head of the toothbrush into the user's mouth and quickly and repetitively moves it back and forth applying lateral pressure against the teeth and/or gum at the same time. Since this is an everyday operation that people do all the time, brushing the teeth becomes automatic and very few people pay particular attention while brushing. People are typically rushed or in a hurry when brushing their teeth. Parents tell the children to hurry in the morning and remind them to be sure to brush their teeth. Children and adults hurriedly brush their teeth at least once, twice or even three times daily in their hectic daily routines. Often times, in the haste, both adults and children end up accidentally injuring themselves by ramming the hard rigid head of the toothbrush into their gum. Sometimes the result is bleeding of the gum which may continue to hurt for several days. Sores within the mouth hurt even more when eating because the salt and the spices tend to seek out the wound. Toothbrush mishaps of this nature occur to everybody sooner or later and occur with greater frequency to young children whose control of movement is somewhat unsteady. Thus, the problem is repeated again and again for millions of people.

An additional problem associated with oral hygiene and toothbrushes is that toothbrushes are not usually replaced regularly and thus are often times used significantly beyond their effective useful life. The dental profession has recommended toothbrush replacement after about three months of use, however, many people continue to use the same old worn out toothbrush for as long as a year. Efforts have been made in earnest to inform people to regularly replace their toothbrush, even to the extent of providing a toothbrush which changes in color to signal that it is time to replace the toothbrush.

U.S. Pat. No. 4,082,255 to Breuer et al. discloses a toothbrush having a colored region of filaments adapted to change in color intensity in response to increase use of the toothbrush to provide a signal indicating filament wear. While the '255 patent discloses a color signal to indicate that it is time to replace the toothbrush, this requires that the user understands that a change in color means that it's time to replace the toothbrush. However, it is also very possible that the user fails to replace the toothbrush since the color change is gradual over a period of time and/or the user fails to remember what the color change indicates, or the user does not replace the toothbrush because the appearance of the bristles may still appear fine even though the bristles have changed color. What is needed is a more positive reminder or indicator to the user to cause the user to replace the toothbrush regularly as recommended by the dental profession.

It is desirable to have a practical and useful toothbrush which effectively eliminates the self-inflicted injuries occurring while brushing one's teeth. It is desirable to have a toothbrush which is safe to use and inexpensive to manufacture. It is further desirable to have a toothbrush which actively informs the user that it is time to replace the worn out toothbrush. It is further desirable to have a toothbrush which effectively prevents extended usage beyond the effective life of the toothbrush.

BRIEF SUMMARY OF THE INVENTION

The present invention is a safety toothbrush having a wear indicator. The safety toothbrush according to the present invention effectively eliminates self-inflicted injuries occurring while brushing one's teeth. The safety toothbrush according to the present invention also actively informs the user when it is time to replace the toothbrush due to wear or usage. The safety toothbrush of the present invention not only protects the user's gums but also positively indicates and causes the user to replace the toothbrush in a predetermined time based on usage.

The present invention provides a safety feature to the conventional toothbrush by attaching a soft bumper to the end of the toothbrush head. The toothbrush head holds the tufts for brushing and is opposite the handle end. The soft bumper is preferably made of an impact absorbing material such as rubber, either natural or synthetic, or in the form of an air cushion, and is attached to the end of the toothbrush head by means of adhesive or embedment or both. The soft bumper is of sufficient thickness to render its effectiveness.

The soft bumper is particularly useful in protecting the user's gum whenever there is an accidental slip or miss resulting in ramming the head of the toothbrush into the user's gum. The soft bumper softens the hit and thus prevents damage to the gum. The soft bumper adds little to the overall costs in manufacturing this new safety toothbrush.

It is anticipated that this new and useful safety feature incorporated into the conventional toothbrush will be welcomed and preferred by millions of people all over the world.

An additional useful feature of the toothbrush of the present invention is that the soft bumper can be attached in such a manner that side portions of the soft bumper or the entire soft bumper will become disengaged with the toothbrush head after the toothbrush has experienced a certain amount of wear. The disengagement of the side portions or the entire soft bumper with the head not only indicates that the toothbrush should be replaced but presents an unacceptable operating condition causing positive replacement of the toothbrush.

BRIEF DESCRIPTION OF THE DRAWINGS

The present invention may be more readily described and understood by the reference to the accompanying drawing in which.

DETAILED DESCRIPTION OF THE INVENTION

Figure 1:
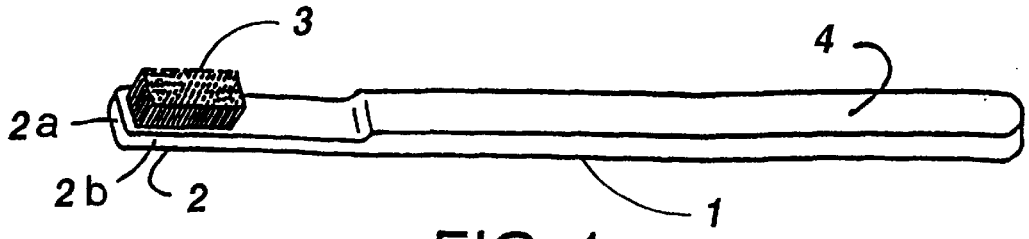
FIG. 1 is a perspective view of a prior art conventional toothbrush.

Referring to FIG. 1 (prior art), a typical conventional toothbrush made of an elongated rigid hard body 1 having a head 2 at one end holding the tufts or bristles 3 for brushing the other body end serving as a handle 4. The head 2 has an end face 2*a* and a pair of sides 2*b*. The end face 2*a* in the drawings has been shown as generally planer and transverse to the pair of sides 2*b*. It is to be understood that the configuration of the head 2 can vary from flat trim to oval or any other suitable shape and further that the present invention is applicable to all such configurations.

Figure 5:
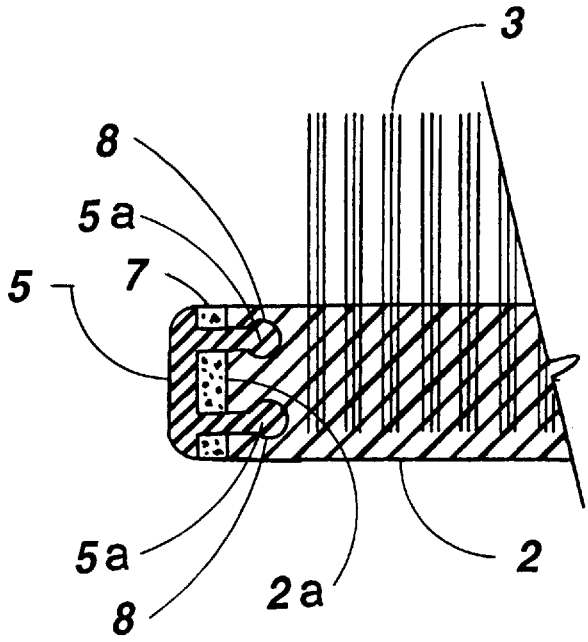
FIG. 5 is an enlarged view taken along line 5—5 of FIG. 3 showing a means for attaching a soft bumper to the end face of the toothbrush head.
Figure 6:
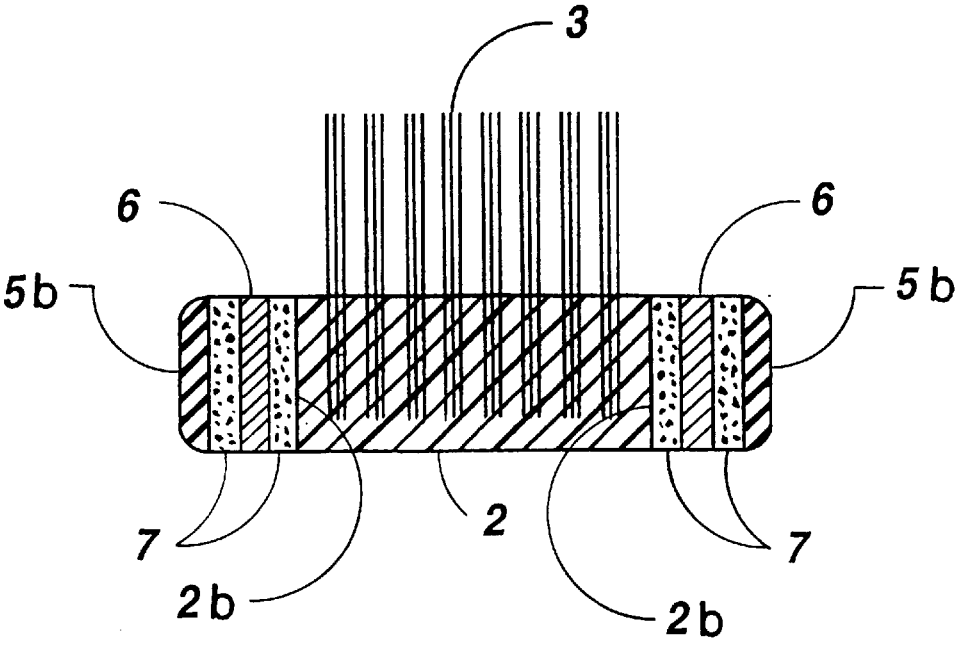
FIG. 6 is an enlarged view taken along line 6—6 of FIG. 3 showing a means for attaching the soft bumper extensions to the sides of the toothbrush head.
Figure 6A:
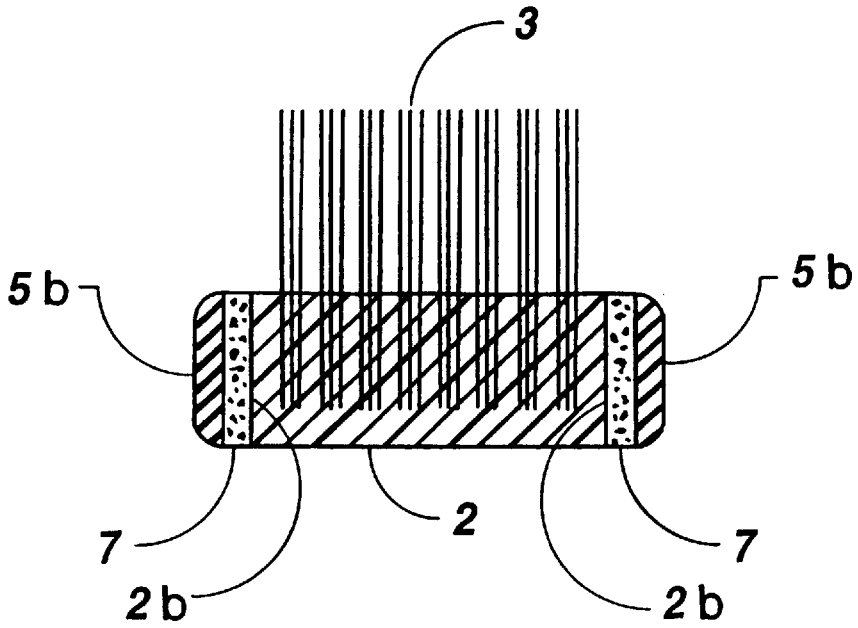
FIG. 6A is a view similar to FIG. 6 showing an alternate means for attaching the soft bumper extensions to the sides of the toothbrush head.
Figure 7:
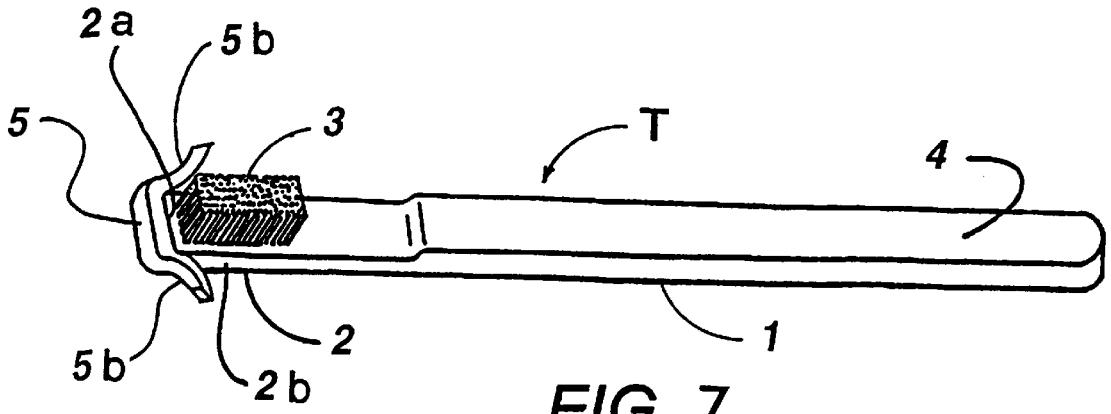
FIG. 7 is a perspective view of the safety toothbrush with wear indicator showing the toothbrush in a used and worn condition.
Figure 8:
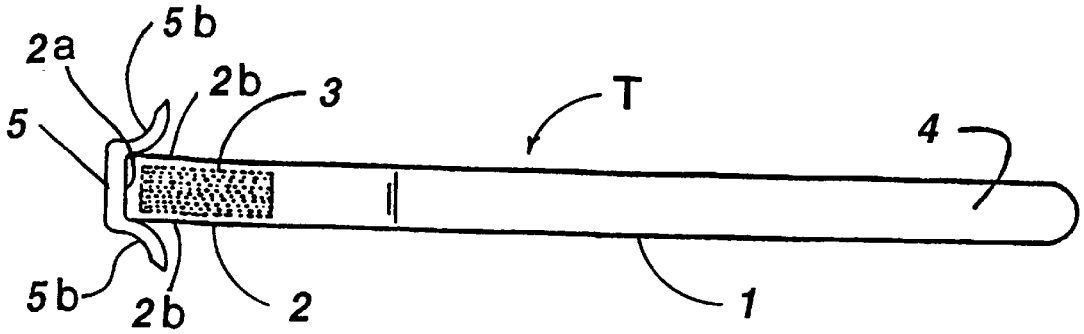
FIG. 8 is a top plan view of the safety toothbrush with wear indicator of FIG. 7.
Figure 9:
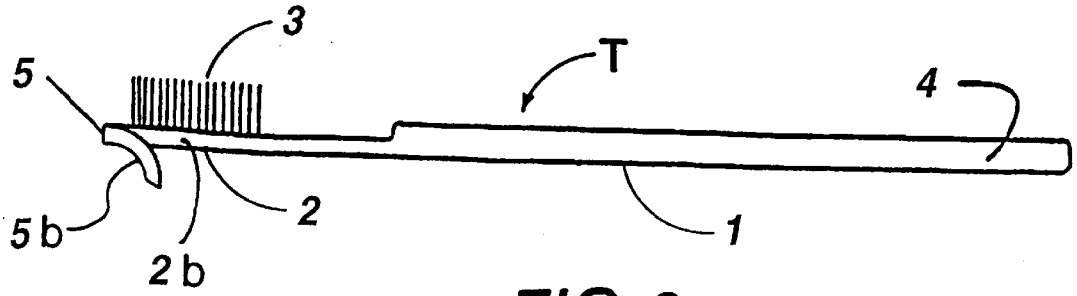
FIG. 9 is a side elevational view of the safety toothbrush with wear indicator of FIG. 7.

The preferred embodiment of the safety toothbrush with wear indicator, generally referred to as T, according to the present invention is illustrated in FIGS. 2–9. FIGS. 2–6A depict the safety toothbrush T in a usable condition and FIGS. 7–9 depict the safety toothbrush T in an unacceptable worn condition.

Referring to FIGS. 2–5C, 6 and 6A, a soft bumper 5 is attached to the end face 2*a* and the pair of sides 2*b* of the head 2. Preferably, the soft bumper 5 is made of an impact absorbing material such as soft rubber, either natural or synthetic, and is attached to the head 2 by means of adhesive or embedment of both. Preferably, the soft bumper 5 is of sufficient thickness to render its effectiveness ranging anywhere from 1/64" to 1/8" or more, preferably approximately 3/32".

Figure 2:
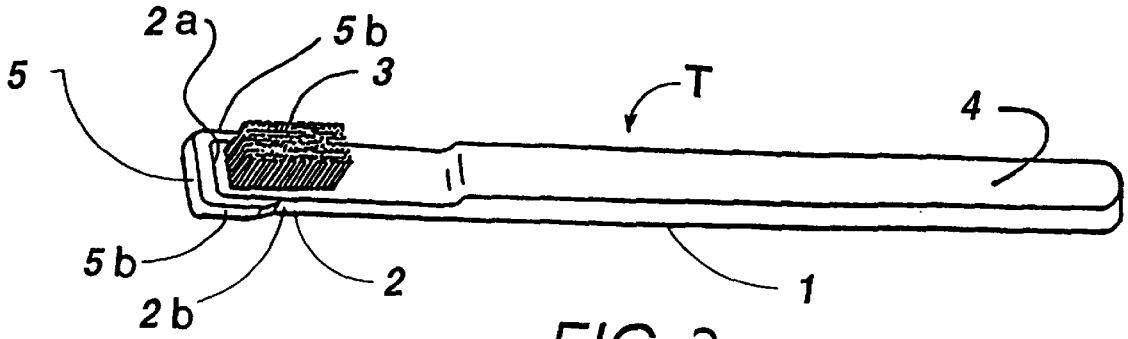
FIG. 2 is a perspective view of a safety toothbrush with wear indicator according to the present invention.
Figure 3:
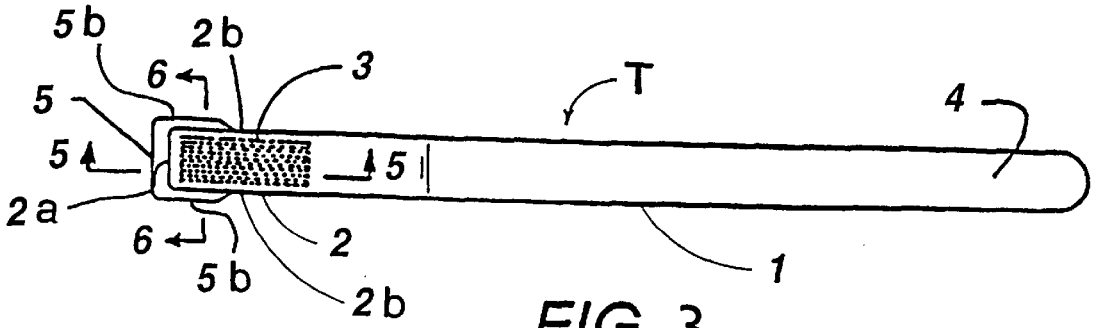
FIG. 3 is a top plan view of the safety toothbrush with wear indicator shown in FIG. 2.
Figure 4:
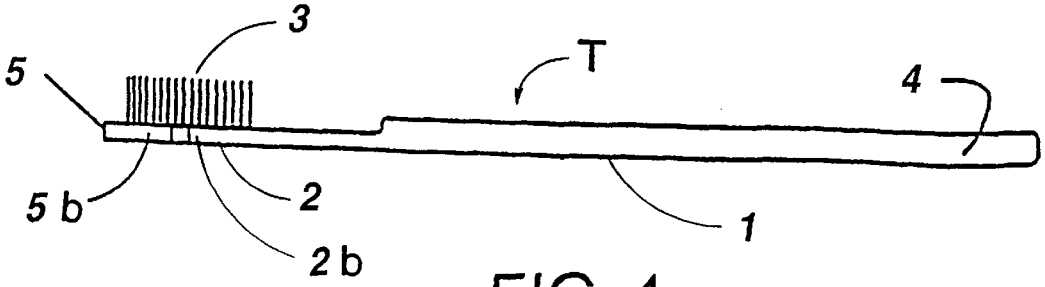
FIG. 4 is a side elevational view of the safety toothbrush with wear indicator shown in FIG. 2.
Figure 10:
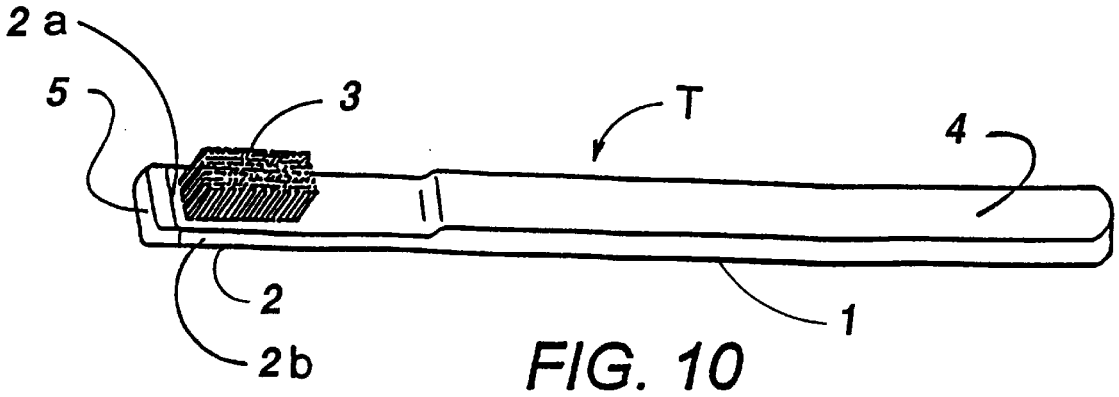
FIG. 10 is a perspective view of a safety toothbrush according to the present invention.
Figure 11:
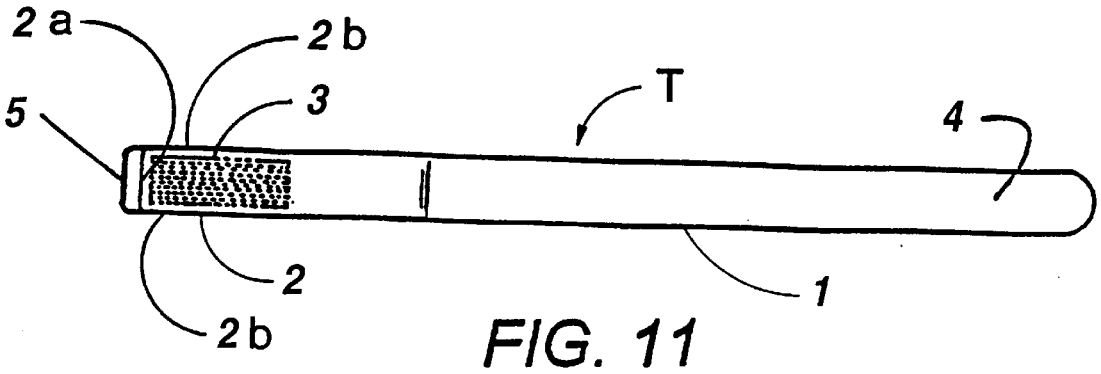
FIG. 11 is a top plan view of the safety toothbrush shown in FIG. 10.
Figure 12:
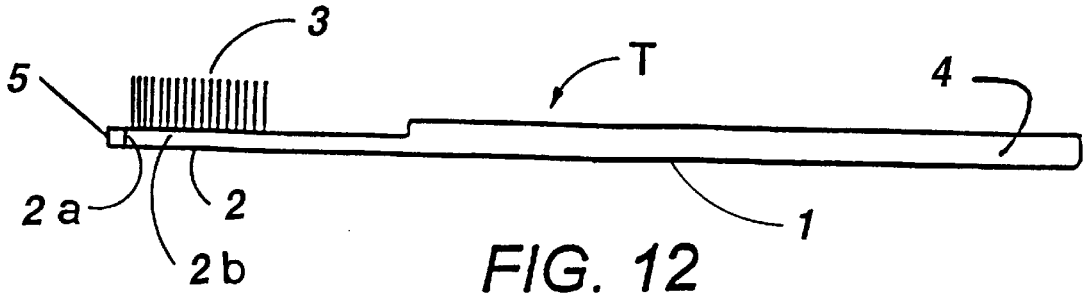
FIG. 12 is a side elevational view of the safety toothbrush shown in FIG. 10.

Referring to FIGS. 2–4, in the preferred embodiment of the safety toothbrush with wear indicator T, the soft bumper 5 is attached to the end face 2*a* and the pair of sides 2*b* of the head 2. It is to be understood that alternately the soft bumper 5 is not required to extend onto the pair of sides 2*b* but could be attached only to the end face 2*a* as indicated in FIGS. 10–12. Referring to FIGS. 10–12, the soft bumper 5 could have a length approximating the length of the end face 2*a* and be attached to the end face 2*a*. To provide the safety features of the present invention into the toothbrush T it is of primary importance that the end face 2*a* be covered or partially covered with the soft bumper 5 to minimize or eliminate the damaging effects of a mishandled toothbrush within the user's mouth. It is to be understood that the configuration and shape of the head 2 can vary but the coverage of the frontal end face 2*a* by the soft bumper 5 remains.

Figure 5A:
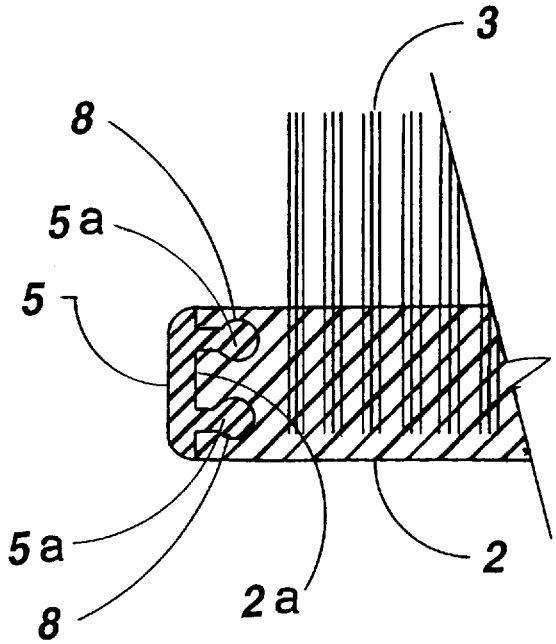
FIGS. 5A–5C are views similar to FIG. 5 showing alternate means for attaching the soft bumper to the end face of the toothbrush head.
Figure 5B:
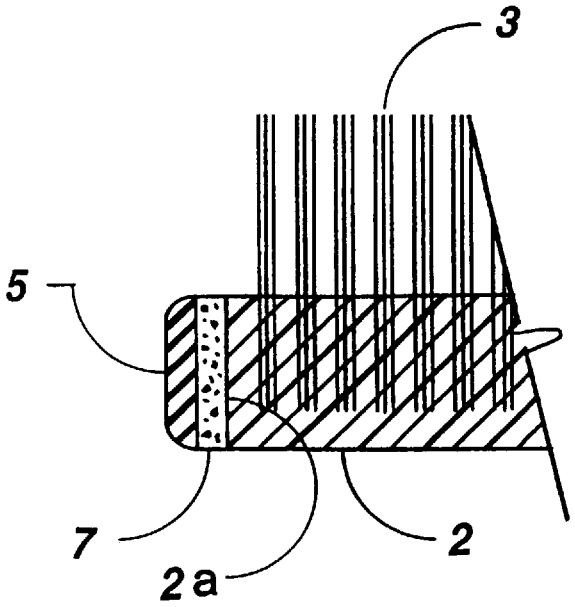

There are various means of attaching the soft bumper 5 to the head 2 as shown in FIGS. 5–5C, 6, and 6A. As previously mentioned, the soft bumper 5 can be attached to the head 2 by adhesive 7 (FIGS. 5B and 6A) or embedment (FIG. 5A) or both (FIG. 5). Referring to FIGS. 5 and 5A, the soft bumper 5 to head 2 attachment is shown as comprising one or more cavities 8 in the end face 2*a* which receive corresponding tabs 5*a* in the soft bumper 5. The exact number, size and configuration of the cavities 8 and tabs 5*a* can vary so long as the purpose of attachment of the soft bumper 5 to the head 2 is served. Additionally, an adhesive 7 (FIG. 5) is used to attach the soft bumper 5 to the end face 2*a*. Alternatively, the adhesive 7 may be omitted as shown in FIG. 5A if the embedment secures the soft bumper 5 to the head 2. Yet another alternative is shown in FIG. 5B in which the soft bumper 5 is secured to the end face 2*a* entirely by adhesive 7.

Preferably, the soft bumper 5 attaches to the head 2 in such a manner that a portion of the soft bumper 5 becomes disengaged with the toothbrush head 2 after the toothbrush T has experienced a certain amount of wear or usage. The disengagement of a portion of the soft bumper 5 with the head 2 indicates that the toothbrush T should be replaced.

Preferably, the soft bumper 5 has extensions 5*b* which are attached to the pair of sides 2*b* of the head 2 as shown in FIGS. 2–4, 6 and 6A. The preferred method to accomplish the wear indicator feature is shown in FIG. 6. In FIG. 6, a water soluble spacer 6 having a predetermined thickness is glued between the bumper extension 5*b* and the head side 2*b*. Thus, an adhesive, indicated as 7 in FIG. 6, glues the spacer 6 to the head side 2*b* and the extension 5*b* to the spacer 6. It is to be understood that the soft bumper 5, spacer 6 and adhesive 7 have been exaggerated in the drawings for clarity purposes. The water soluble spacer 6 is dissolved over time with a predetermined number of wetting cycles resulting from usage of the toothbrush T. Upon the spacer 6 dissolving, the extensions 5*b* are no longer attached to the head sides 2*b* and the unacceptable operating condition of the toothbrush T results as shown in FIGS. 7–9.

Figure 5C:
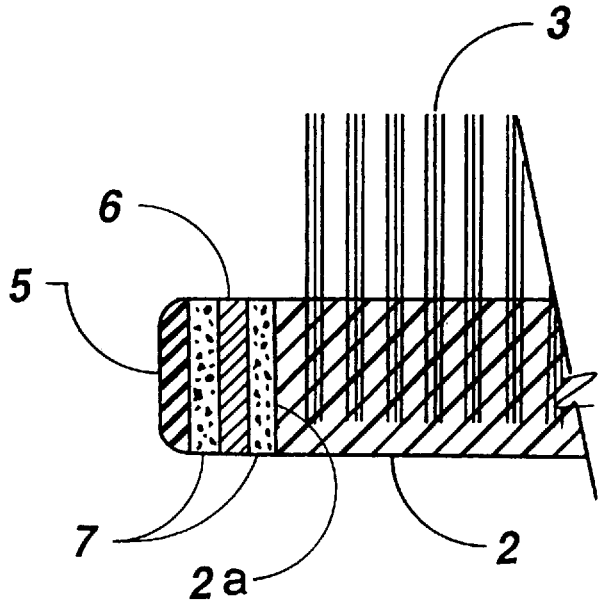
Figure 5D:
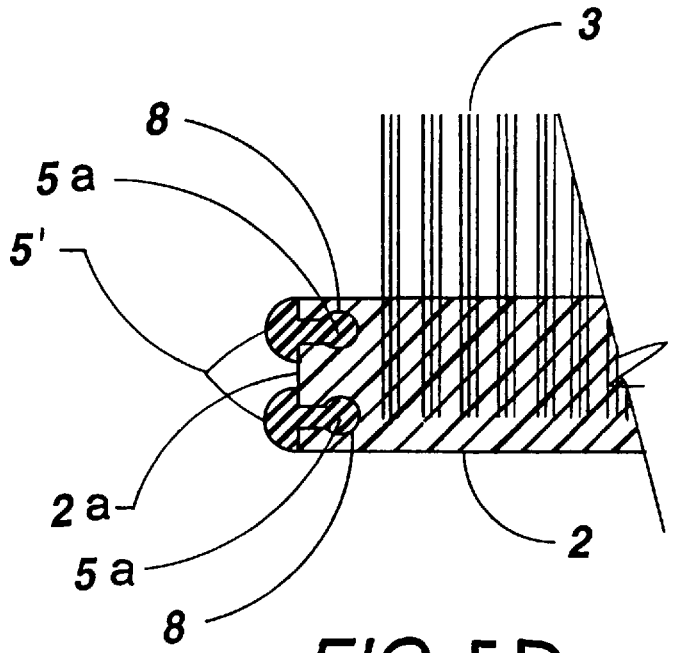
FIG. 5D is a view similar to FIG. 5 showing another alternate embodiment of the soft bumper attached to the end face of the toothbrush head.
Figure 5E:
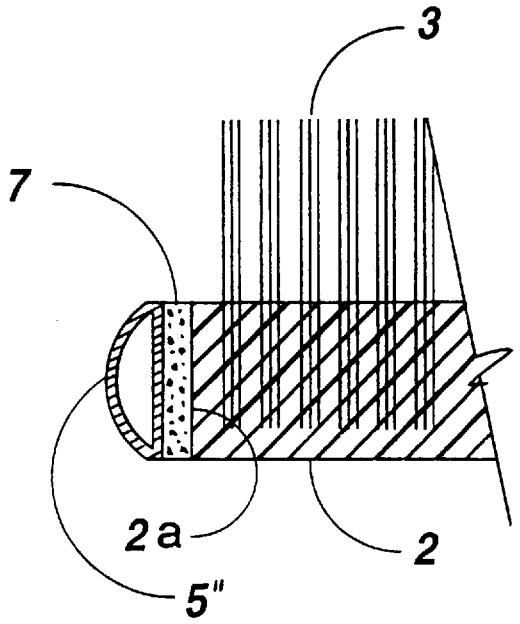
FIG. 5E is a view similar to FIG. 5 showing another alternate embodiment of the soft bumper attached to the end face of the toothbrush head.
Figure 5F:
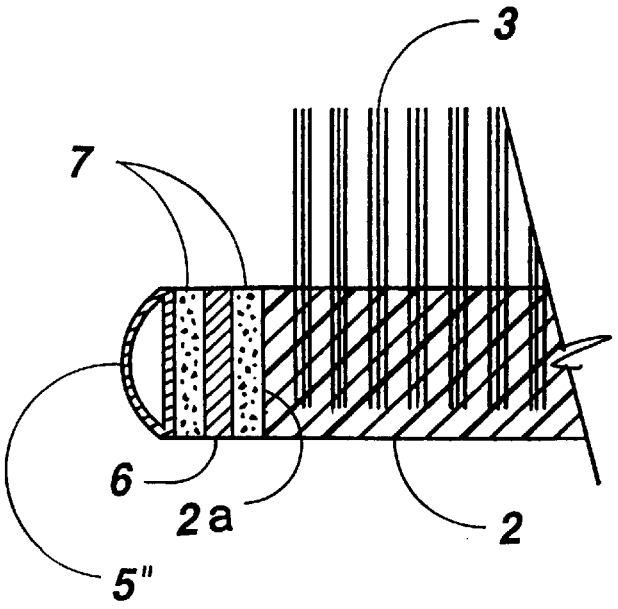
FIG. 5F is a view similar to FIG. 5E showing alternate means for attaching the soft bumper to the end face of the toothbrush head.

Alternatively, the water soluble spacer 6 could be positioned along the entire length of the soft bumper 5 and between the soft bumper 5 and the head 2 as shown in FIGS. 5C, 5F and 6. In this embodiment, the entire soft bumper 5 becomes detached from the head 2 at the predetermined time corresponding to the time to replace the toothbrush T.

Alternatively, the extension 5*b* can be adhesively secured to the sides 2*b* of the head 2 as shown in FIG. 6A. The adhesive 7 used to attach the extensions 5*b* to the sides 2*b* is preferably an adhesive which loses it adhesive quality after a predetermined number of wetting cycles to release the extensions 5*b* from the sides 2*b* of the head 2 as shown in FIGS. 7–9. When the extensions 5*b* release from the sides 2*b*, this positively signals to the user that the toothbrush T is in an unacceptable operating condition and needs to be replaced. Preferably, for safety purposes the portion of the soft bumper S attached to the end face 2*a* remains attached as a result of the embedment or use of a permanent adhesive, or both as depicted in FIGS. 5–5B. Alternatively, the entire soft bumper 5 can be allowed to become detached from the head 2, if desired, by using the non-permanent adhesive to also attach the soft bumper 5 to the end face 2*a* in the embodiment shown in FIG. 5B.

The water soluble spacer 6 can be made from a material that dissolves or melts away after repeated contact with water such as gelatin, for example, the type gelatin used in the manufacturing of hard and/or soft capsules for medications. The spacer 6 would be designed to have a life expectancy substantially equal to the recommended life of the toothbrush T. Alternatively, the adhesive used in the embodiment without the spacer 6 would be designed to be a time release adhesive which would lose its adhesive quality upon a predetermined number of wetting cycles such as cyanoacrylate adhesives, for example, Sicomet 8300 adhesive as manufactured by Henkel Adhesives Corporation, 1345 Gasket Drive, Elgin, Ill. 60120.

It is to be understood that the extensions 5*b* can be thinner than the frontal portion of the soft bumper 5 since the primary purpose of the extensions 5*b* is to cause an unacceptable operating condition as opposed to forming a soft impact absorbing surface.

In FIG. 5D, an alternate embodiment of the soft bumper, designated as 5', is shown comprising a pair of bumpers embedded into the end face 2*a* of the head 2 in a similar manner as discussed above.

In FIG. 5E, another embodiment of the soft bumper, designated as 5", is an impact absorbing cushion filled with air, liquid or gel. The soft bumper 5" is shown secured to the end face 2*a* with adhesive 7. In FIG. 5F, the soft bumper 5" is shown secured to the end face 2*a* with a water soluble space 6 and adhesive 7 in a similar manner as discussed above.

It is to be understood that the soft bumpers 5' and 5" can be secured to the head 2 in any manners discussed above.

As can be seen from FIGS. 2–9, the improvement of the soft bumper 5, 5', and 5' to the conventional toothbrush is particularly useful in protecting the user's gum whenever there is an accidental slip or miss which results in ramming the head 2 into the user's gum. The soft bumpers 5, 5' and 5" eliminates the hard strike against the gum by the hard end face of 2*a* of the head 2 and instead softens the impact with the gum by providing an impact absorbing bumper. The improvement of the soft bumper 5, 5' and 5" to the conventional toothbrush can be attached in such a manner that the soft bumper 5, 5' and 5" or a portion 5*b* of the soft bumper will become disengaged with the toothbrush head 2 after the toothbrush T has experienced a certain amount of wear. The disengagement of the soft bumper 5, 5' and 5" or a portion 5*b* of the soft bumper with the head 2 indicates that the toothbrush T should replaced.

From the drawings and description presented, it is evident that the novel soft bumper and wear indicator improvement of the conventional toothbrush is both easy and practical to make adding little to the overall costs of manufacturing.

It is expected that the novel and useful features of the soft bumper 5, 5' and 5" of the improved toothbrush T as shown in FIGS. 2–12 surely will be welcomed and preferred by millions of people over the prior art toothbrush FIG. 1.

The foregoing disclosure and description of the invention is illustrative and explanatory thereof, and various changes in size, shape, and materials, as well as in the details of illustrative constructions and assembly, may be made without departing from the spirit of the invention.

I claim:

1. An improved toothbrush of the type having an elongated rigid hard body having a head on a first end and a handle on a second end, the head holding the tufts for brushing, the improvement comprising a soft bumper attached to the head, wherein the head has an end face and said soft bumper is attached to the end face; and wherein a water soluble spacer is adhered to the end face and said soft bumper is adhered to said water soluble spacer.

2. The toothbrush of claim 1, wherein said water soluble spacer dissolves after a predetermined number of wetting cycles to release said soft bumper.

3. An improved toothbrush of the type having an elongated rigid hard body having a head on a first end and a handle on a second end, the head holding the tufts for brushing, the improvement comprising a soft bumper attached to the head, wherein the head has an end face and said soft bumper is attached to the end face; wherein the head has a pair of sides and said soft bumper extends from the end face and onto the sides of the head; and wherein a water soluble spacer is adhered to the sides and said soft bumper has extensions which are adhered to said water soluble spacer.

4. The toothbrush of claim 3, wherein said water soluble spacer is also adhered to the end face and said soft bumper is adhered to said water soluble spacer; and wherein said water soluble spacer dissolves after a predetermined number of wetting cycles to release said soft bumper and said soft bumper extensions.

5. The toothbrush of claim 3, wherein said water soluble spacer dissolves after a predetermined number of wetting cycles to release said soft bumper extensions from the sides.

6. An improved toothbrush of the type having an elongated rigid hard body having a head on a first end and a handle on a second end, the head holding the tufts for brushing, the improvement comprising a soft bumper attached to the head, wherein the head has an end face and said soft bumper is attached to the end face; wherein said soft bumper is attached to the head with adhesive; and wherein said adhesive releases said soft bumper from the head after a predetermined number of wetting cycles.

7. An improved toothbrush of the type having an elongated rigid hard body having a head on a first end and a handle on a second end, the head holding the tufts for brushing, the improvement comprising a soft bumper attached to the head, wherein the head has an end face and said soft bumper is attached to the end face; wherein the head has a pair of sides and said soft bumper extends from the end face and onto the sides of the head; wherein said soft bumper has extensions which are attached to the pair of sides with adhesive; and wherein said adhesive releases said soft bumper extensions from the sides of the head after a predetermined number of wetting cycles.

8. An improved toothbrush of the type having an elongated rigid hard body having a head on a first end and a handle on a second end, the head holding the tufts for brushing, the improvement comprising a soft bumper attached to the head, wherein the head has an end face and said soft bumper is attached to the end face with adhesive; wherein the head has a pair of sides and said soft bumper extends from the end face and onto the sides of the head; wherein said soft bumper has extensions which are attached to the pair of sides with adhesive; and wherein said adhesive releases said soft bumper and said soft bumper extensions from said head after a predetermined number of wetting cycles.

* * * * *